United States Patent [19]

Cohrs

[11] Patent Number: 4,949,505

[45] Date of Patent: Aug. 21, 1990

[54] DOOR CORDINATOR

[75] Inventor: Richard B. Cohrs, Indianapolis, Ind.

[73] Assignee: Von Duprin, Inc., Indianapolis, Ind.

[21] Appl. No.: 357,228

[22] Filed: May 26, 1989

[51] Int. Cl.[5] ..... E05C 7/05

[52] U.S. Cl. ..... 49/367

[58] Field of Search ..... 49/367, 368, 369, 366

[56] References Cited

U.S. PATENT DOCUMENTS

| | | | |
|---|---|---|---|
| 2,015,996 | 10/1935 | Eichacker | 49/366 |
| 3,822,506 | 7/1974 | Fishbach | 49/367 |
| 3,895,461 | 7/1975 | Maynard, Jr. et al. | 49/367 |
| 4,146,994 | 4/1979 | Williams | 49/367 |

*Primary Examiner*—Philip C. Kannan

*Attorney, Agent, or Firm*—Walter C. Vliet

[57] ABSTRACT

The coordinator has a pair of spaced-apart limbs pivotably mounted to a housing; one of the limbs functions to hold a door open, whereas the other limb is disclosed for impingement by another door and, as a consequence thereof, causes activation of the door coordinator, i.e., triggers a proper, sequential closing of the two doors, in which the inactive door proceeds to close, while the active door is held open. A carriage slidably mounted to the housing has a lobe which intrudes into the pivotable arc of one of the limbs to prevent that limb from allowing its door to close before the door, held open by the other limb, has closed. A blocking arm keeps the carriage in its lobe-intrusive position, and has a linkage with the other limb. Accordingly, as the other limb permits the closure of its door, the linkage moves the blocking arm to allow the second door to close. If an unusually excessive force is applied to the second door, toward its closure before the other, a rod supported by the carriage moves against the blocking arm, displaces it, and allows the second door to close.

8 Claims, 1 Drawing Sheet

DOOR CORDINATOR

Figure 1:
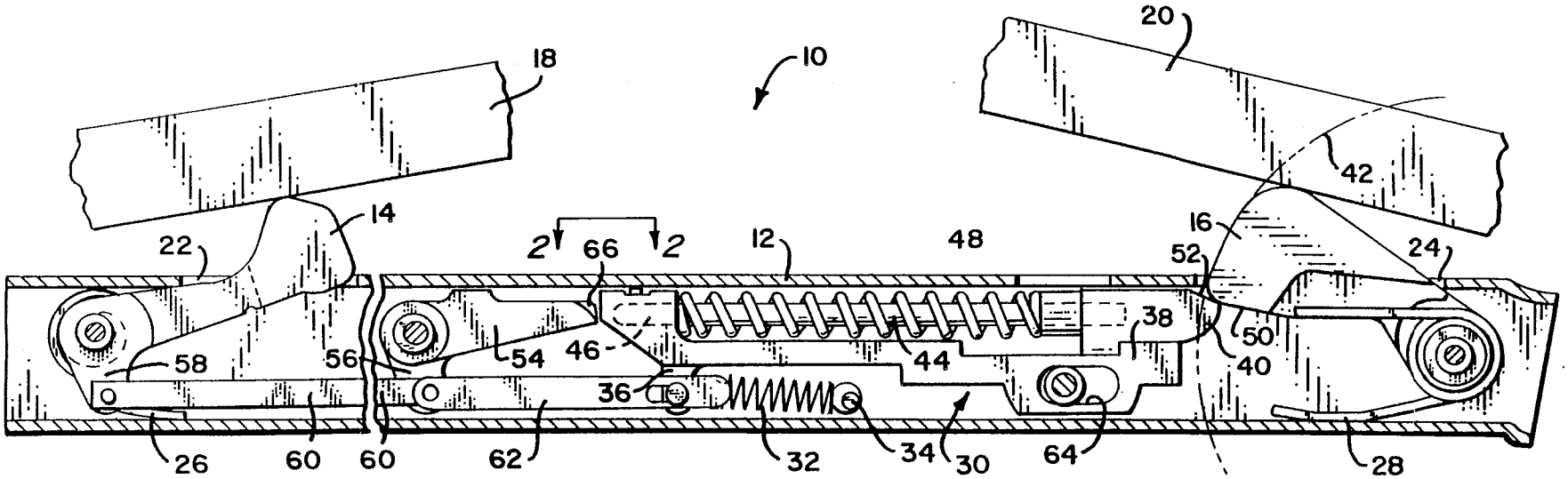

This invention pertains to door coordinators, i.e., mechanisms which control pairs of doors to insure that one of the pair closes before the other thereof, and in particular to an improved door coordinator having an override feature designed to prevent damage to the doors and/or the coordinator, if there is an attempt to close one of the doors out of sequence.

Pairs of door are frequently constructed with overlapping edges, or astragals. In order for such doors to close and seal properly, one door, the so-called "inactive" door, must close prior to the other, "active" door. To accomplish this, mechanism holds the active door open until the inactive door is closed; the inactive door depresses a lever and the active door is released and allowed to close. The unit containing the controlling mechanism is a door coordinator, and typical thereof is that disclosed in U.S. Pat. No. 3,895,461, issued on July 22, 1975, to Ralph D. Maynard, Jr., et al, for a "Door Coordinator Assembly".

It is an object of this invention to set forth an improved door coordinator, and such a coordinator which will permit the closure of the active door, due to an unusually excessive closing force being applied thereto, prior to closure of the inactive door, without any resulting damage to the coordinator or the doors, and automatic resetting of the proper closing sequence when the doors are next opened again.

It is particularly an object of this invention to set forth a door coordinator comprising a housing; a pair of limbs mounted to said housing, in spaced-apart locations, for movement thereof, relative to said housing, between passive and operative dispositions thereof, in which one of said limbs, when in said operative disposition thereof, holds a door open, and the other of limbs, when in said operative disposition, is set for impingement by another door to cause said other limb to activate said door coordinator; and a carriage mounted to said housing for movement thereof, relative to said housing, between first and second positions; wherein said carriage has means engageable with one of said limbs of said pair, while said carriage is in its first position, for inhibiting movement of said one limb from its operative disposition to its passive disposition; and including means, mounted to said housing for movement thereof, relative to said housing, between primary and secondary attitudes thereof, for (a) blocking said carriage and preventing its movement from said first position thereof to its second position, when said blocking means is in its primary attitude, and (b) unblocking said carriage, for carriage movement to its second position, when said blocking means is in its secondary attitude; and means commonly joining said blocking means and the other limb of said pair for moving said blocking means from its primary attitude to its secondary attitude, coincident with movement of said other limb from its operative disposition to its passive disposition.

Figure 2:
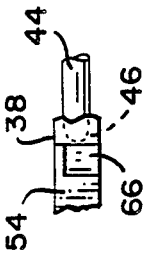

Further objects of this invention, as well as the novel features thereof, will become more apparent by reference to the following description, taken in conjunction with the accompanying figures, in which:

FIG. 1 is a plan view of an embodiment of a door coordinator, according to the invention, shown in relation to fragmentary portions of a pair of independently hinged, companion doors, and with the tubular housing shown in cross-section; and FIG. 2 is a detailed view, taken along 2—2 of FIG. 1, albeit with the housing omitted for clarity, showing the relationship of the end of the blocking arm and its ramp surface to the interfacing end of the carriage.

As shown in the figures, a door coordinator 10, according to the invention, comprises a housing 12 in which a pair of limbs 14 and 16 are pivotably mounted. Limb 14 is provided for impingement thereof by an inactive door 18, and limb 16 holds open active door 20. The housing has slits 22 and 24 formed therein to accommodate the limbs in their operative dispositions, as shown. For the purposes of this discussion, the limbs 14 and 16 are deemed in their passive dispositions, when pivotably retracted into the housing 12, and as stated, in their operative dispositions when extended through the slits 22 and 24 to hold their respective doors 18 and 20. Hairpin springs 26 and 28 are engaged with the limbs 14 and 16 to bias them out through the slits 22 and 24. A carriage 30 is slidably pinned to the housing 12, and an expansion spring 32 fixed at ends thereof to a pin 34 and to a lug 36 urges the carriage 30 to the right (as viewed in FIG. 1). The carriage 30 has a frame 38, from which the lug 36 depends, and a lobe 40 at an end thereof to control the limb 16. Limb 16 pivots through an arc 42 into which the lobe 40 intrudes. As door 20 opens, the limb 16 displaces the lobe 40 and moves out into the slit 24. This is possible, as the lobe 40 is carried on the end of a guide rod 44 which is slidably supported in a channel 46 provided therefor in the frame 38; a compression spring 48 set about the rod 44 urges the lobe 40 to assume the position shown. However, when door 20 proceeds to close, the limb 16 is obstructed by the lobe 40. The engaging surfaces 50 and 52 of the limb 16 and the lobe 40 inhibit a retraction of the limb 16 into the housing 12. It is necessary that door 18 close first. To insure that this will normally occur, the fame 38, at the end in which the channel 46 is formed, is confronted by a blocking arm 54 which is pivotably mounted to the housing 12. The arm 54 also has a lug 56 which is joined to a lug 58 depending from limb 14 by a link 60. As door 18 closes, and moves the limb 14 into the housing, the link 60 causes the blocking arm 54 to pivot and withdraw from its blocking position before the frame 38. Too, lug 56 is also joined to the carriage 30 by another link 62 which is coupled to the lug 36. The carriage 30 moves to the left (as viewed in FIG. 1), the frame 38 having an elongated slot 64 accommodating for this, and removes the lobe from obstruction of the limb 16. The expansion spring 32 insures that the carriage 30 will return to its normal, or at rest, attitude, with the lobe 40 in surmounting engagement with the limb 16.

It does occur that an unusually excessive closing force will be applied to the active door 20, toward closing thereof before door 18. To permit this out-of-sequence closure, the invention has means preventing damage to either the doors or the coordinator 10. With great force applied to the door 20, the limb 16 will force the lobe 40 to retract therefrom, against the bias of the spring 48. Consequently, the opposite end of the rod 44, which is hemispheric, will protrude from the channel 46 and engage a ramp surface 66 formed on a portion of the confronting end of the blocking arm 54. The rod end forces itself along the ramp surface 66 and causes the arm 54 to slue out of the way. Door 20 will close and the mechanism is prevented from sustaining damage. Now, it is of little consequence that door 18 shall have closed against door 20—instead of the alternate arrangement—as with the next opening of the doors, the coordinator 10 will automatically, and properly, sequence the door closings again.

While I have described my invention in connection with an embodiment thereof it is to be clearly understood that this is done only by way of example, and not as a limitation to the scope of the invention as set forth in the objects thereof and in the appended claims.

I claim:

1. A door coordinator, comprising:

a housing;

a pair of limbs mounted to said housing, in spaced-apart locations, for movement thereof, relative to said housing, between passive and operative dispositions thereof, in which one of said limbs, when in said operative disposition thereof, holds a door open, and the other of said limbs, when in said operative disposition, is set for impingement by another door to cause said other limb to activate said door coordinator; and a carriage mounted to said housing for movement thereof, relative to said housing, between first and second positions; wherein said carriage has means engageable with one of said limbs of said pair, while said carriage is in its first position, for inhibiting movement of said one limb from its operative disposition to its passive disposition; and including means, mounted by attachment to said housing for movement thereof, relative to said housing, between primary and secondary attitudes thereof, for (a) blocking said carriage and preventing its movement from said first position thereof to its second position, when said blocking means is in its primary attitude, and (b) unblocking said carriage, for carriage movement to its second position, when said blocking means is in its secondary attitude;

means commonly joining said blocking means and the other limb of said pair for moving said blocking means from its primary attitude to its secondary attitude, coincident with movement of said other limb from is operative disposition to its passive disposition;

said blocking means comprises an arm pivotable on said housing;

said carriage comprises a frame slidable on said housing; and an end of said arm engages an end of said frame when said blocking means is in its primary attitude.

2. A door coordinator, according to claim 1, wherein:

said arm has a projecting lug;

said other limb has a projecting lug; and said joining means comprises a link coupled at either ends thereof to said lugs.

3. A door coordinator, according to claim 1, wherein:

said frame has a projecting lug; and further including a link, coupled at either ends thereof, to said lug of said arm and said lug of said frame.

4. A door coordinator, according to claim 1, wherein:

said one limb is pivotable on said housing through a given arc; and said carriage further comprises a lobe which intrudes into said arc.

5. A door coordinator, according to claim 4, wherein:

said lobe is slidably engaged with said frame.

6. A door coordinator, according to claim 5, wherein:

said end of said frame comprises a channel;

one end of a guide rod is slidably engaged with said channel, and the opposite end of said guide rod is coupled to said lobe.

7. A door coordinator, according to claim 6, wherein:

said end of said arm has a ramp surface formed thereon; and said one end of said guide rod has a hemispherical termination engageable with said ramp surface.

8. A door coordinator, according to claim 1, wherein:

said carriage further has means movable relative thereto, and responsive to an unusually forceful movement of said one limb from its operative disposition toward its passive disposition, for moving said blocking means from its primary attitude to its secondary attitude.

* * * * *